US010465863B2

(12) United States Patent
Hou et al.

(10) Patent No.: US 10,465,863 B2
(45) Date of Patent: Nov. 5, 2019

(54) ASSEMBLY LIGHT APPARATUS

(71) Applicant: XIAMEN ECO LIGHTING CO. LTD., Xiamen (CN)

(72) Inventors: Shouqiang Hou, Xiamen (CN); Xiaoliang Wen, Xiamen (CN); Jinfan Zhang, Xiamen (CN); Maojin Zeng, Xiamen (CN); Qiaorong Chen, Xiamen (CN); Changjing Zeng, Xiamen (CN)

( * ) Notice: Subject to any disclaimer, the term of this patent is extended or adjusted under 35 U.S.C. 154(b) by 0 days.

(21) Appl. No.: 15/927,229

(22) Filed: Mar. 21, 2018

(65) Prior Publication Data

US 2019/0293246 A1 Sep. 26, 2019

(51) Int. Cl.

| | |
|---|---|
| ***F21L 4/04*** | (2006.01) |
| ***F21V 21/116*** | (2006.01) |
| ***F21V 21/14*** | (2006.01) |
| ***F21V 19/00*** | (2006.01) |
| ***F21V 19/02*** | (2006.01) |
| ***F21V 21/088*** | (2006.01) |
| ***F21Y 115/10*** | (2016.01) |

(52) U.S. Cl.

CPC ..... *F21L 4/04* (2013.01); *F21V 19/001* (2013.01); *F21V 19/02* (2013.01); *F21V 21/0885* (2013.01); *F21V 21/116* (2013.01); *F21V 21/145* (2013.01); *F21Y 2115/10* (2016.08)

(58) Field of Classification Search

CPC ..... F21L 4/04; F21V 21/0885; F21V 21/116; F21V 21/145; F21V 21/26; F21V 21/28–29; F21V 21/108; F21V 19/02; F21V 19/001; F21Y 2115/10

See application file for complete search history.

(56) References Cited

U.S. PATENT DOCUMENTS

| | | | | |
|---|---|---|---|---|
| 2009/0168422 | A1* | 7/2009 | Chiu | F21S 2/005 362/249.03 |
| 2013/0271993 | A1* | 10/2013 | Jan | F21V 21/30 362/249.09 |
| 2014/0268775 | A1* | 9/2014 | Kennemer | F21L 14/00 362/249.03 |
| 2018/0202639 | A1* | 7/2018 | Kao | F21V 21/30 |

FOREIGN PATENT DOCUMENTS

| | | | |
|---|---|---|---|
| CN | 205174036 U | * | 4/2016 |
| CN | 106568007 A | * | 4/2017 |
| CN | 206478485 U | * | 9/2017 |

* cited by examiner

*Primary Examiner* — Joseph L Williams
*Assistant Examiner* — Jose M Diaz
(74) *Attorney, Agent, or Firm* — LanWay IPR Services; Chun-Ming Shih

(57) ABSTRACT

An assembly light apparatus has a station bracket, a fixed light module, and a portable light module. The station bracket has a fixed holder, a detachable holder and a pose adjuster structure. The fixed light module is fixed on the fixed holder. The portable light module is selectively attached on the detachable holder. The pose adjuster structure is operated to rotate to change an angle and a position of the fixed holder and the detachable holder with respect to the station bracket.

19 Claims, 8 Drawing Sheets

ASSEMBLY LIGHT APPARATUS

FIELD OF INVENTION

The present invention is related to an assembly light apparatus and more particularly related to an assembly light apparatus with detachable component.

BACKGROUND

There are various light devices in daily life. In modern society, light devices are an important symbol as well as tools to support today's civilization growing.

Some light devices are fixed in the ceiling like downlight devices. Some are placed on table, and some other light devices are used for various working needs. For example, a photographer needs various light devices to create a desired luminous environment. Some light devices need to be portable to be conveniently moved and placed in working environments.

Innovative light devices might not appear important as they are. But it is helpful to enhance human life when various novel light devices are invented and provided to the world. Such innovation may be on decreasing manufacturing cost, adding features, or making light devices more portable or with more functions.

Therefore, it is beneficial to continue find out innovative light designs in such crowded art. Any innovation advancement may bring certain advancement of this society, by finding new design, new technical problems and new technical solutions to bring new products.

SUMMARY OF INVENTION

According to an embodiment of the present invention, an assembly light apparatus has a station bracket, a fixed light module, and a portable light module.

The station bracket has a fixed holder, a detachable holder and a pose adjuster structure. The fixed light module is fixed on the fixed holder.

The portable light module is selectively attached on the detachable holder. Specifically, users may take the portable light module from the detachable holder and operates the portable light module independently. Users may place the portable light module on the detachable holder to work together with the fixed light module.

The pose adjuster structure may be operated by users for certain rotation operation to change an angle and a position of the fixed holder and the detachable holder with respect to the station bracket.

In some embodiments, the fixed light module has two fixed units located at two sides of the detachable holder. In such arrangement, the portable light module, when being placed on the detachable holder, is between two fixed units of the fixed light module. In some embodiments, the two fixed units emit light with larger half intensity angles than the portable light module. The half intensity angle is a measure to indicate whether light emitted from a light device is condensed as a light beam or a more diffused light pattern. The term 'half' refers to the angle where when light beyond the angle has less than 50% luminous intensity. Usually, the light with larger half intensity is better used for environment luminous source and the light with smaller half intensity is better used to focus and emphasize an object being projected on.

Such design is great for common works, like a light source for photographer or a scientist to do experiments on certain objects.

Please be noted that, such arrangement is just for exemplary purpose, not to limit the present invention. There may be other variation designs to implement the inventive concept.

For example, there may be four or more light units, instead of the three light units as mentioned above. On the other hand, the fixed light module may have only one unit, instead of two fixed units as mentioned above. Persons of ordinary skilled in the art are supposed being enabled to implement variation based on the disclosure provided herein.

In some embodiments the portable light module is attached to the detachable holder with a magnetic component, e.g. using magnetic force to help locate and attach the portable light module to the detachable holder. For example, a magnet or more may be placed on the portable light module, on the detachable holder or on both of the portable light module and the detachable holder. A metal material that is attacked by the magnet may be placed to produce the attraction to help attach the portable light module to the detachable holder more robustly and more conveniently.

In addition, in some embodiments, the detachable holder has a position structure to ensure the portable light module to keep at a predetermined position with respect to the detachable holder. For example, a block with a corresponding cavity is placed on the portable light module and the detachable holder. More structures like clip, lever, shaft, spring may also be added depending on different designs. The position structure helps ensure the portable light module to stay at a predetermined position with respect to the detachable holder when the portable light module is placed on the detachable holder.

In some embodiments, the portable light module has a battery to provide electricity of the portable light module to work when the portable light module is detached from the detachable holder. In other words, the portable light module, even been detached from the detachable holder, the portable light module may be used as an independent device. In addition to get power from a battery, which is helpful in portable usage, the portable light module may have an interface like a USB socket to receive an external power source depending on different design needs.

In some embodiments, the portable light module has a power electrode connecting to a power receiving electrode of the detachable holder to charge the battery when the portable light module is placed on the detachable holder. The power electrode may be integrated with the magnet as mentioned above. Alternatively, the power electrode may be independent from the magnet as mentioned above. The magnet and the position structure may help keep the power electrode with correction connection with the power receiving electrode.

In some embodiments, to make the portable light module more convenient to be taken, moved or placed on the detachable holder, the portable light module may have a holder bar for user to hold and to escape the portable light module from the detachable holder. Such holder bar may be designed on top housing of the portable light module, e.g. with an inverted U shape holder bar, by which users may insert their fingers to hold the holder bar.

In some embodiments, the portable light module may have a foldable stand, the foldable stand is outreached to keep the portable light module at a desired angle when the portable light module is taken away from the detachable holder, and the foldable stand is retracted for the portable light module to adjoin to the detachable holder when the portable light module is placed on the detachable holder.

In some embodiments, the station bracket has a station battery with larger capacity than a battery of the portable light module. When the portable light module is placed on the detachable holder, the light module has a different operation mode from when the light module is placed on the detachable holder. For example, the portable light module may have a maximum luminous level limit to provide longer use time. Such maximum luminous level limit may be canceled when the portable light module is placed on the detachable holder, where a larger battery exists or even a stationary electricity source, to decrease the concern of saving battery use time. Other functions like wireless circuits in the portable light module may be turned off when there is no sufficient battery supply. Other operation mode, including operation parameters may be prepared in different design needs.

With such design, the portable light module has a different operation manner compared with when the portable light module is integrated with the detachable holder, thus to provide more various flexibility of the assembly light apparatus.

In addition, in some other embodiments, the portable light module may have more than two directions to be placed on the detachable holder, e.g. to be placed in a first direction on the detachable holder and to be placed in a second direction opposite to the first direction. When the portable light module is placed with different directions on the detachable holder, the portable light module may have different operation modes. For example, the same portable light module may have first operation parameters, and users may turn the portable light module upside down, replacing a placement manner of the portable light module on the detachable holder, bringing a different operation mode, including operation parameters.

In some other embodiments, the portable light module may emit a first light pattern in a first side and may emit a second light pattern in a second side. For example, two light plates with different parameters may be placed on two opposite sides of a portable light module.

The first side is opposite to the second side. The first light pattern is different from the second light pattern. The portable light module is selectively placed on the detachable holder with the first side or the second side to choose providing the first light pattern or the second light pattern, respectively.

In such design, users may decide to keep the first side of the portable light module to face outside to emit light or the second side of the portable light module to face outside to emit light. When one side is hidden behind, that side may be turned off automatically, e.g. by placing a switch for detecting position status with respect to the detachable holder.

In such case, only one side emits light at one time, and therefore, the two sides of the portable light module may share the same driver circuit.

In some embodiments, the portable light module has a control terminal for receiving a command from the station bracket. Users may send an operation instruction to the station bracket to operate the fixed light module and the portable light module at the same time.

In some embodiments, the operation instruction mentioned above may be issued by a remote control or a manual control unit, to control both the fixed light module and the portable light module when the portable light module is placed on the detachable holder. In other words, when the portable light module is placed on the detachable holder, the detachable holder may not only serve as a structure holder but also serve as an integrated component to integrate the portable light module to co-work with the fixed light module together, e.g. receiving the same operation instruction like to lower down luminous level. Please be noted that such operation instruction may not be the same when being interpreted as actual control signals. For example, an instruction operation may indicate the portable light module to turn brighter and the fixed light module to decrease luminous level.

In some embodiments, the portable light module has a manual switch for controlling the portable light module when the portable light module is detached from the detachable holder.

In some embodiments, the portable light module is operable independent without the station bracket and has a different operation mode when the portable light module is placed on the detachable holder. In other words, the portable light module may have a different operation manner and parameters depending on whether the portable light module is placed on the detachable holder.

In some embodiments, the detachable holder is designed to mount another portable device except the portable light module. For example, the detachable holder may have a standard USB interface or a wireless charging interface so that a mobile phone, a speaker, a wireless transmitter or other devices may be mounted on the detachable holder, in addition to the portable light module.

In some embodiments, the other device may be another portable light module with different parameters, e.g. a different light emitting pattern.

In some embodiments, the assembly light apparatus may further include a diffusion cover to be selectively covering the portable light module to provide a larger half intensity angle light. The diffusion cover may be used to scatter light to soften the output light.

In some embodiments, the station bracket has a bottom base to be placed on a surface. The post adjuster structure has multiple joint structures to be rotated to change an angle and a height with respect to the surface.

Specifically, as an example, the station bracket has a first bottom joint connected to the bottom base and a second bottom joint connected to the detachable holder to change the height and the angle with respect to the surface.

In some embodiments, the pose adjuster structure has two top joints for the detachable holder to connect to two fixed units, and the two top joints are used for adjust respective angles between the two fixed units and the detachable holder.

There are other variations not mentioned but are supposed to be covered with the disclosure and examples as illustrated as follows.

DETAILED DESCRIPTION

Figure 1:
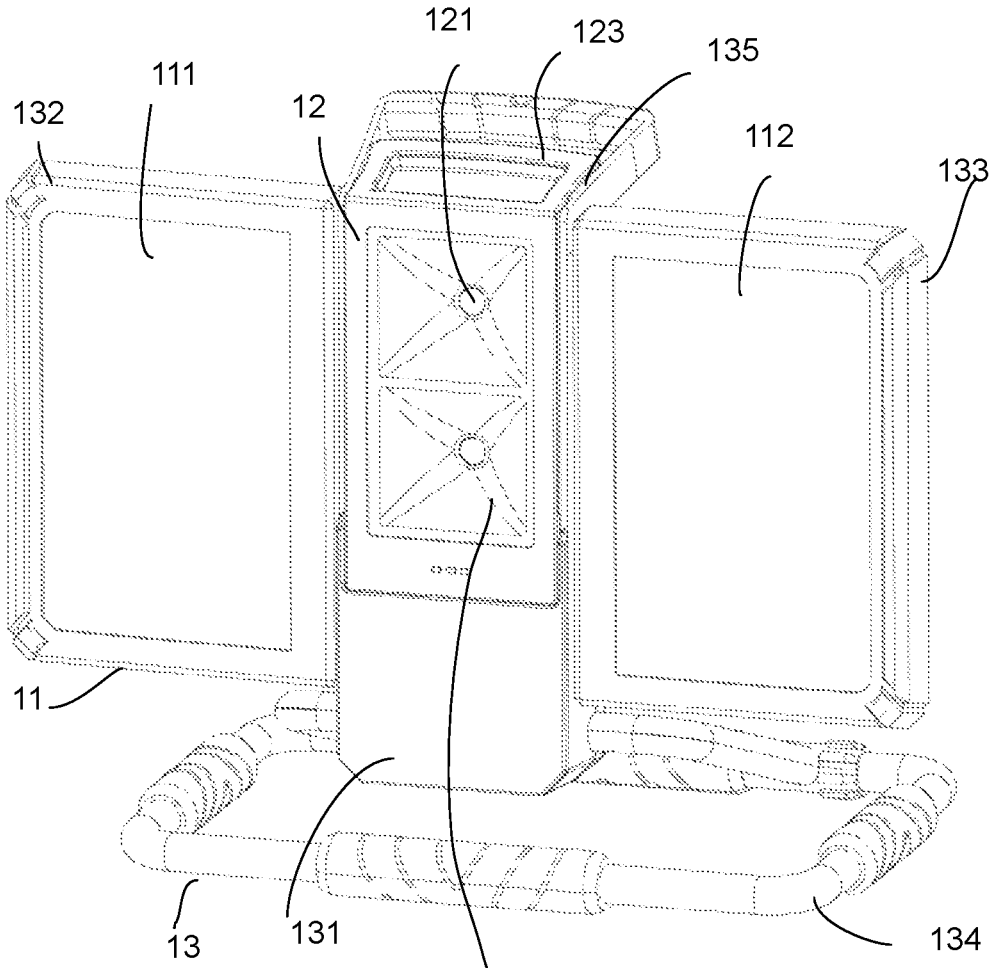
FIG. 1 illustrates an embodiment of an assembly light apparatus.

According to an embodiment of the present invention, an assembly light apparatus has a station bracket, a fixed light module, and a portable light module.

The station bracket has a fixed holder, a detachable holder and a pose adjuster structure. The fixed light module is fixed on the fixed holder.

The portable light module is selectively attached on the detachable holder. Specifically, users may take the portable light module from the detachable holder and operates the portable light module independently. Users may place the portable light module on the detachable holder to work together with the fixed light module.

The pose adjuster structure may be operated by users for certain rotation operation to change an angle and a position of the fixed holder and the detachable holder with respect to the station bracket.

In some embodiments, the fixed light module has two fixed units located at two sides of the detachable holder. In such arrangement, the portable light module, when being placed on the detachable holder, is between two fixed units of the fixed light module. In some embodiments, the two fixed units emit light with larger half intensity angles than the portable light module. The half intensity angle is a measure to indicate whether light emitted from a light device is condensed as a light beam or a more diffused light pattern. The term 'half' refers to the angle where when light beyond the angle has less than 50% luminous intensity. Usually, the light with larger half intensity is better used for environment luminous source and the light with smaller half intensity is better used to focus and emphasize an object being projected on.

Such design is great for common works, like a light source for photographer or a scientist to do experiments on certain objects.

Please be noted that, such arrangement is just for exemplary purpose, not to limit the present invention. There may be other variation designs to implement the inventive concept.

For example, there may be four or more light units, instead of the three light units as mentioned above. On the other hand, the fixed light module may have only one unit, instead of two fixed units as mentioned above. Persons of ordinary skilled in the art are supposed being enabled to implement variation based on the disclosure provided herein.

In some embodiments the portable light module is attached to the detachable holder with a magnetic component, e.g. using magnetic force to help locate and attach the portable light module to the detachable holder. For example, a magnet or more may be placed on the portable light module, on the detachable holder or on both of the portable light module and the detachable holder. A metal material that is attacked by the magnet may be placed to produce the attraction to help attach the portable light module to the detachable holder more robustly and more conveniently.

In addition, in some embodiments, the detachable holder has a position structure to ensure the portable light module to keep at a predetermined position with respect to the detachable holder. For example, a block with a corresponding cavity is placed on the portable light module and the detachable holder. More structures like clip, lever, shaft, spring may also be added depending on different designs. The position structure helps ensure the portable light module to stay at a predetermined position with respect to the detachable holder when the portable light module is placed on the detachable holder.

In some embodiments, the portable light module has a battery to provide electricity of the portable light module to work when the portable light module is detached from the detachable holder. In other words, the portable light module, even been detached from the detachable holder, the portable light module may be used as an independent device. In addition to get power from a battery, which is helpful in portable usage, the portable light module may have an interface like a USB socket to receive an external power source depending on different design needs.

In some embodiments, the portable light module has an power electrode connecting to a power receiving electrode of the detachable holder to charge the battery when the portable light module is placed on the detachable holder. The power electrode may be integrated with the magnet as mentioned above. Alternatively, the power electrode may be independent from the magnet as mentioned above. The magnet and the position structure may help keep the power electrode with correction connection with the power receiving electrode.

In some embodiments, to make the portable light module more convenient to be taken, moved or placed on the detachable holder, the portable light module may have a holder bar for user to hold and to escape the portable light module from the detachable holder. Such holder bar may be designed on top housing of the portable light module, e.g. with an inverted U shape holder bar, by which users may insert their fingers to hold the holder bar.

In some embodiments, the portable light module may have a foldable stand, the foldable stand is outreached to keep the portable light module at a desired angle when the portable light module is taken away from the detachable holder, and the foldable stand is retracted for the portable light module to adjoin to the detachable holder when the portable light module is placed on the detachable holder.

In some embodiments, the station bracket has a station battery with larger capacity than a battery of the portable light module. When the portable light module is placed on the detachable holder, the light module has a different operation mode from when the light module is placed on the detachable holder. For example, the portable light module may have a maximum luminous level limit to provide longer use time. Such maximum luminous level limit may be canceled when the portable light module is placed on the detachable holder, where a larger battery exists or even a stationary electricity source, to decrease the concern of saving battery use time. Other functions like wireless circuits in the portable light module may be turned off when there is no sufficient battery supply. Other operation mode, including operation parameters may be prepared in different design needs.

With such design, the portable light module has a different operation manner compared with when the portable light module is integrated with the detachable holder, thus to provide more various flexibility of the assembly light apparatus.

In addition, in some other embodiments, the portable light module may have more than two directions to be placed on the detachable holder, e.g. to be placed in a first direction on the detachable holder and to be placed in a second direction opposite to the first direction. When the portable light module is placed with different directions on the detachable holder, the portable light module may have different operation modes. For example, the same portable light module may have first operation parameters, and users may turn the portable light module upside down, replacing a placement manner of the portable light module on the detachable holder, bringing a different operation mode, including operation parameters.

In some other embodiments, the portable light module may emit a first light pattern in a first side and may emit a second light pattern in a second side. For example, two light plates with different parameters may be placed on two opposite sides of a portable light module.

The first side is opposite to the second side. The first light pattern is different from the second light pattern. The portable light module is selectively placed on the detachable holder with the first side or the second side to choose providing the first light pattern or the second light pattern, respectively.

In such design, users may decide to keep the first side of the portable light module to face outside to emit light or the second side of the portable light module to face outside to emit light. When one side is hidden behind, that side may be turned off automatically, e.g. by placing a switch for detecting position status with respect to the detachable holder.

In such case, only one side emits light at one time, and therefore, the two sides of the portable light module may share the same driver circuit.

In some embodiments, the portable light module has a control terminal for receiving a command from the station bracket. Users may send an operation instruction to the station bracket to operate the fixed light module and the portable light module at the same time.

In some embodiments, the operation instruction mentioned above may be issued by a remote control or a manual control unit, to control both the fixed light module and the portable light module when the portable light module is placed on the detachable holder. In other words, when the portable light module is placed on the detachable holder, the detachable holder may not only serve as a structure holder but also serve as an integrated component to integrate the portable light module to co-work with the fixed light module together, e.g. receiving the same operation instruction like to lower down luminous level. Please be noted that such operation instruction may not be the same when being interpreted as actual control signals. For example, an instruction operation may indicate the portable light module to turn brighter and the fixed light module to decrease luminous level.

In some embodiments, the portable light module has a manual switch for controlling the portable light module when the portable light module is detached from the detachable holder.

In some embodiments, the portable light module is operable independent without the station bracket and has a different operation mode when the portable light module is placed on the detachable holder. In other words, the portable light module may have a different operation manner and parameters depending on whether the portable light module is placed on the detachable holder.

In some embodiments, the detachable holder is designed to mount another portable device except the portable light module. For example, the detachable holder may have a standard USB interface or a wireless charging interface so that a mobile phone, a speaker, a wireless transmitter or other devices may be mounted on the detachable holder, in addition to the portable light module.

In some embodiments, the other device may be another portable light module with different parameters, e.g. a different light emitting pattern.

In some embodiments, the assembly light apparatus may further include a diffusion cover to be selectively covering the portable light module to provide a larger half intensity angle light. The diffusion cover may be used to scatter light to soften the output light.

In some embodiments, the station bracket has a bottom base to be placed on a surface. The post adjuster structure has multiple joint structures to be rotated to change an angle and a height with respect to the surface.

Specifically, as an example, the station bracket has a first bottom joint connected to the bottom base and a second bottom joint connected to the detachable holder to change the height and the angle with respect to the surface.

In some embodiments, the pose adjuster structure has two top joints for the detachable holder to connect to two fixed units, and the two top joints are used for adjust respective angles between the two fixed units and the detachable holder.

Please refer to FIG. 1. FIG. 1 illustrates an embodiment of an assembly light apparatus.

In FIG. 1, an assembly light apparatus includes a station bracket 13, a fixed light module 11 with two units 111 and 112, a portable light module 12.

The portable light module 12, in this example, has two LED modules 121, 122 for emitting light with a smaller half intensity angle, e.g. to emphasize a luminous area. In contrast, the two units 111 of the fixed light module 11 may provide a larger half intensity angle, e.g. LED behind a diffusion cover to provide soften light.

The portable light module 123 is detachable from a detachable holder 131. The detachable holder 131 may have a position structure 135 for positioning the portable light module 12 to stay in predetermined position of the detachable holder 131. The fixed light module 11 is fixed on a fixed holder 132, 133 for fixing the two units 111, 112 of the fixed light module 11.

The station bracket 13, in this example is a bracket made with tubes and rotation joints. The tubes form a bottom base 134.

Figure 2:
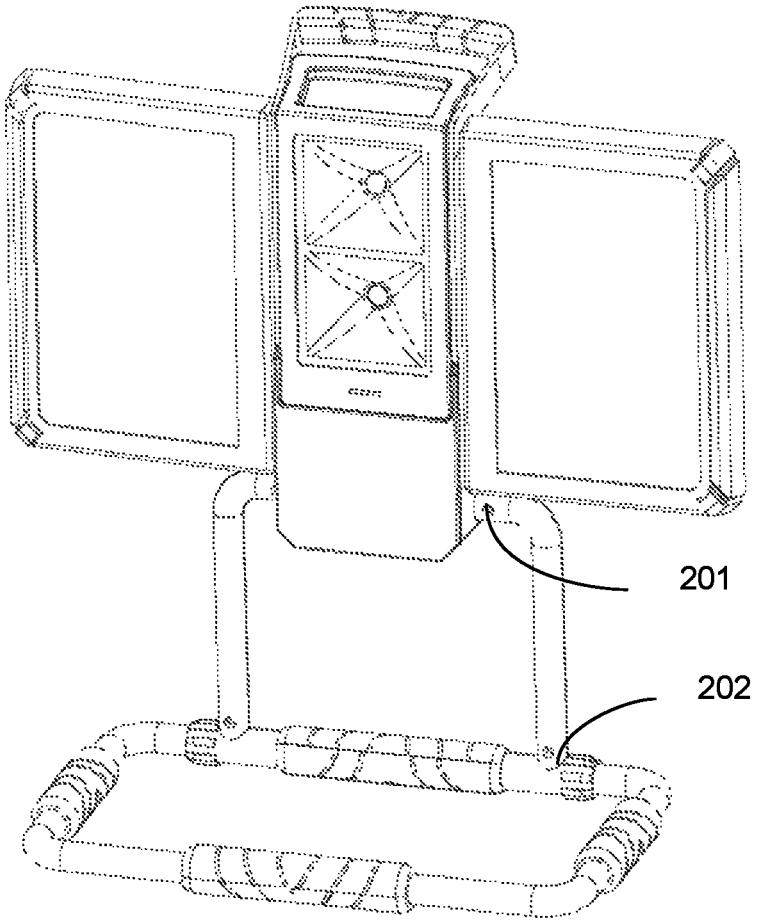
FIG. 2 illustrates a different operation status of the embodiment of FIG. 1.

FIG. 2 illustrates a different operation status of the embodiment of FIG. 1.

In FIG. 2, the station bracket has a bottom base to be placed on a surface, the post adjuster structure having a plurality of joint structures, including two illustrated rotation joints 201, 202 to be rotated to change an angle and a height with respect to the surface.

FIG. 2 illustrates rotates the two joints to make the portable light module and the fixed light module with higher position with respect to the surface the assembly light apparatus is placed.

Figure 3:
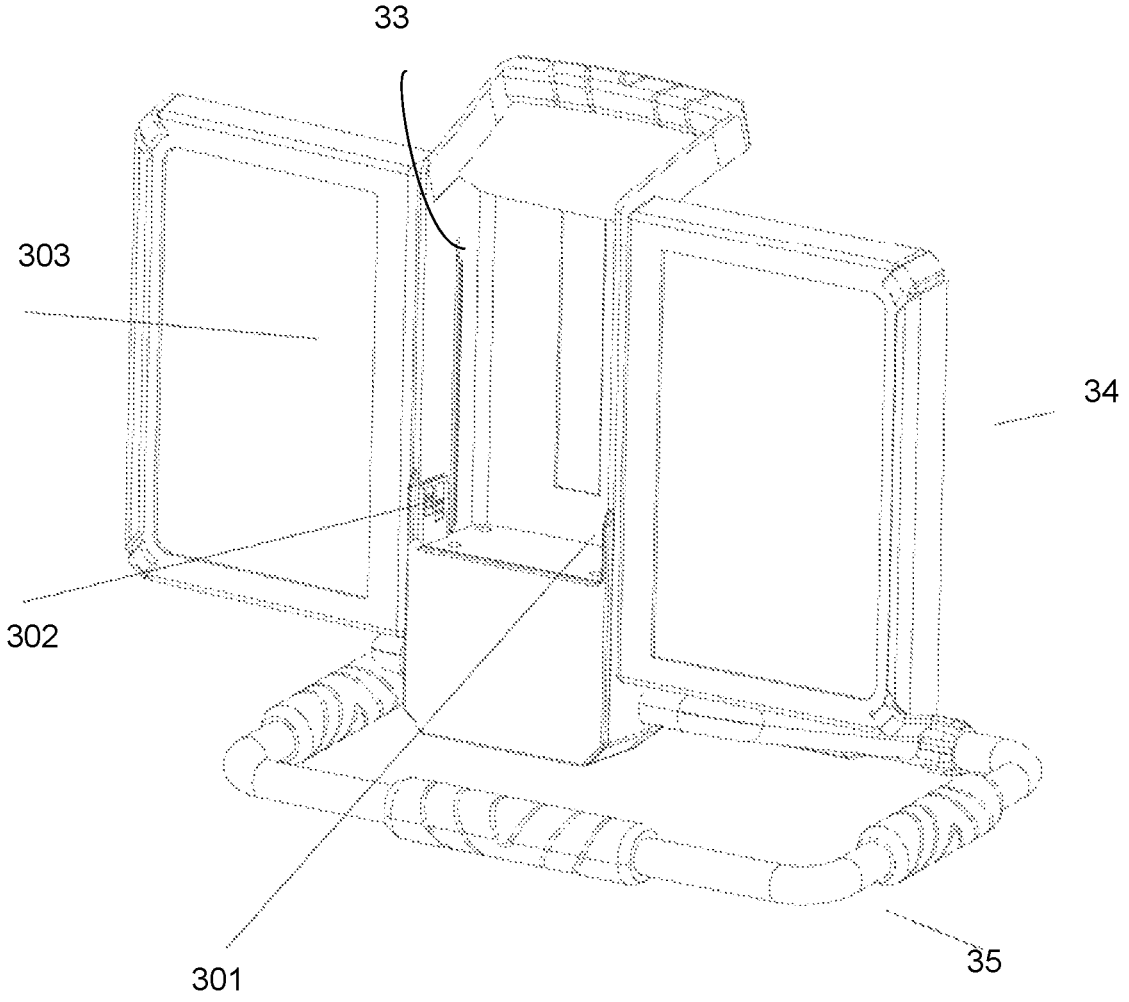
FIG. 3 illustrates the embodiment of FIG. 1 when its portable light module is detached.

FIG. 3 illustrates the assembly light apparatus 34 of FIG. 1 when its portable light module is detached.

In FIG. 3, the detachable holder has two electrodes 301, 302 for providing electricity power and control signal to the portable light module when the portable light module is placed on the detachable holder. Even when the portable light module is not on the detachable holder, the fixed light module 303 may still work independently, e.g. to provide a basic environment luminous function. When the portable light module is placed, the control signal may be sent to the portable light module via the electrode 302.

To make it easier and more accurately placing the portable light module, the detachable holder may have some track 33 as the position structure. The station bracket 35, as mentioned above, may have a larger battery.

Figure 4:
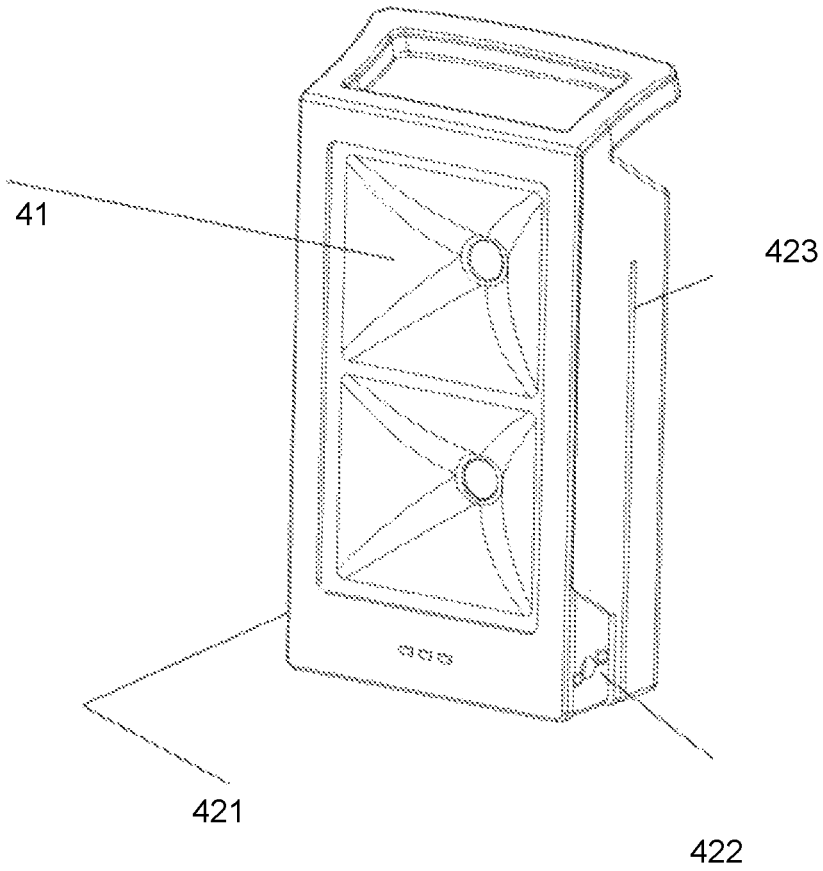
FIG. 4 illustrates a portable light module.

FIG. 4 illustrates a portable light module. The portable light module with LED modules 41 may have corresponding electrodes 421, 422 connected to two electrodes in FIG. 3 for receiving power and control signals. A strip 423 may correspond to the track 33 to keep the portable light module more easily to fit in the detachable holder in the right position.

Figure 5:
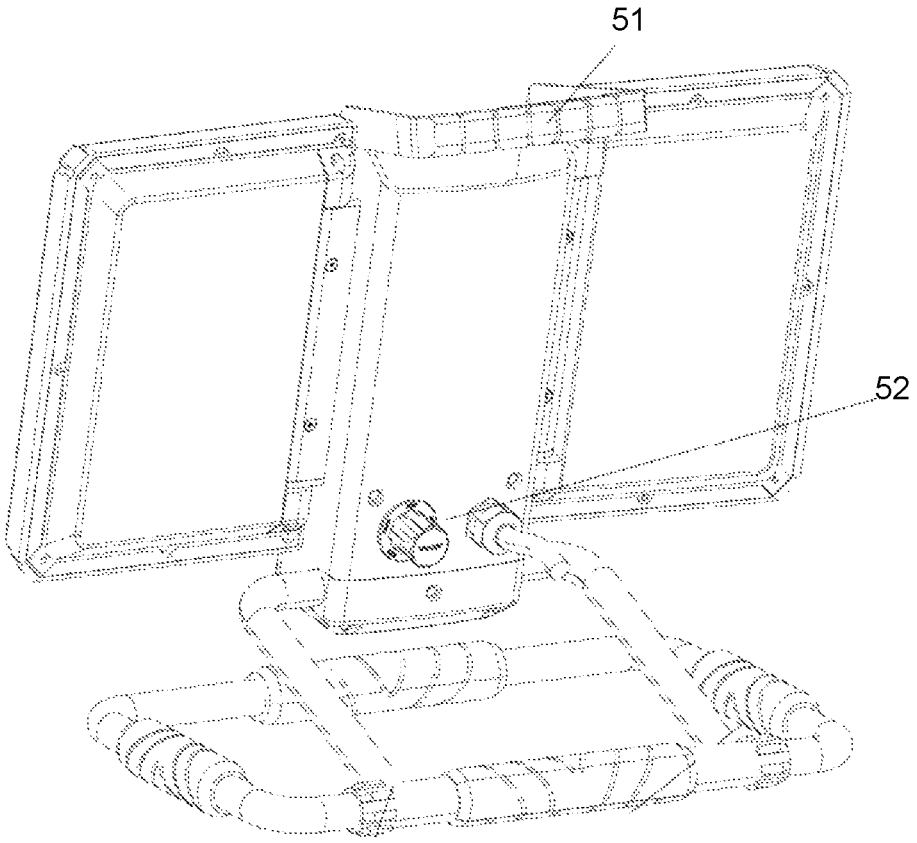
FIG. 5 illustrates a back view of the embodiment of FIG. 1.

FIG. 5 illustrates a back view of the embodiment of FIG. 1. A holding bar 51 may be provided for users to be conveniently to move the assembly light apparatus, even the portable light module is not mounted on the detachable holder.

A manual control switch 52 may be connected to a control circuit, which sends overall control signal to control both the fixed light module and the portable light module as mentioned above.

Figure 6:
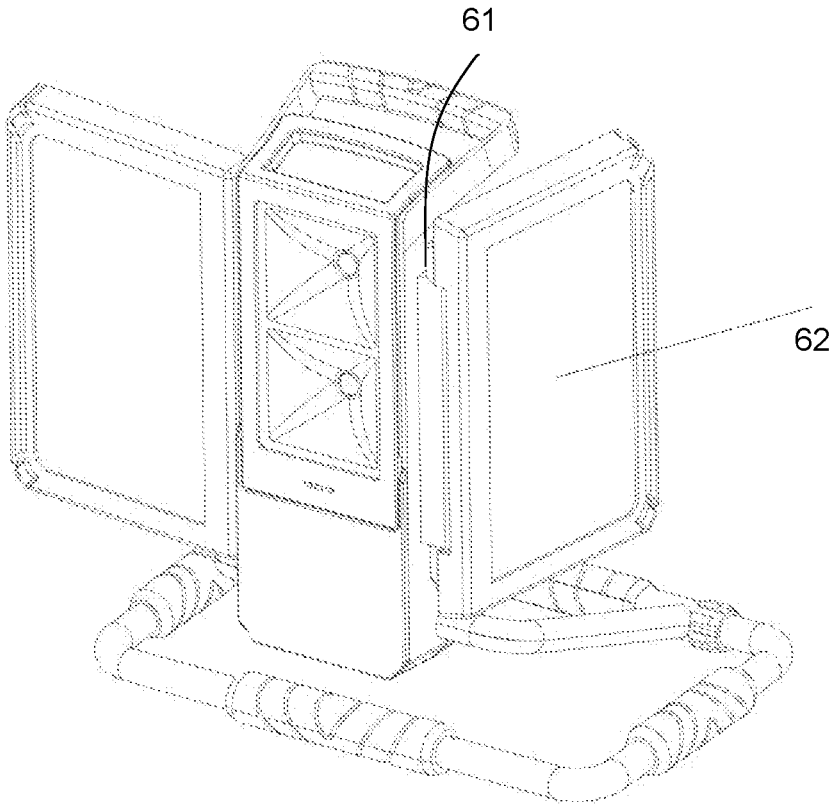
FIG. 6 illustrates a rotation is performed on a pose adjuster structure of a station bracket.

FIG. 6 illustrates a rotation is performed on a pose adjuster structure of a station bracket. In FIG. 6, a rotation shaft 61 is placed between the portable light module and the fixed light module 62 to adjust angle between the portable light module and the fixed light module 62.

Figure 7:
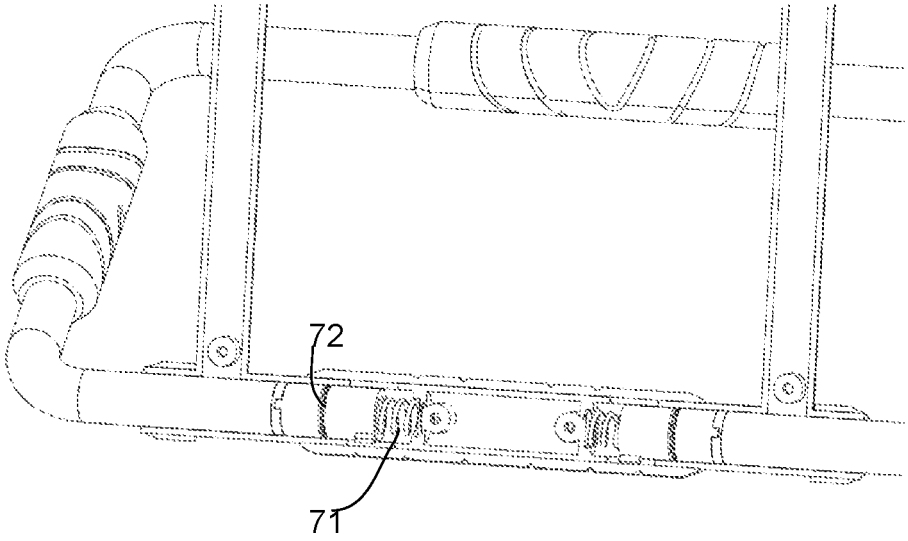
FIG. 7 illustrates a portion of components in the station bracket.

FIG. 7 illustrates a portion of components in the station bracket. In FIG. 7, a spring with a teeth wheel 72 together creates a discrete rotation structure, so that users may be convenient and more robustly adjust the rotation angle of the station bracket.

Figure 8A:
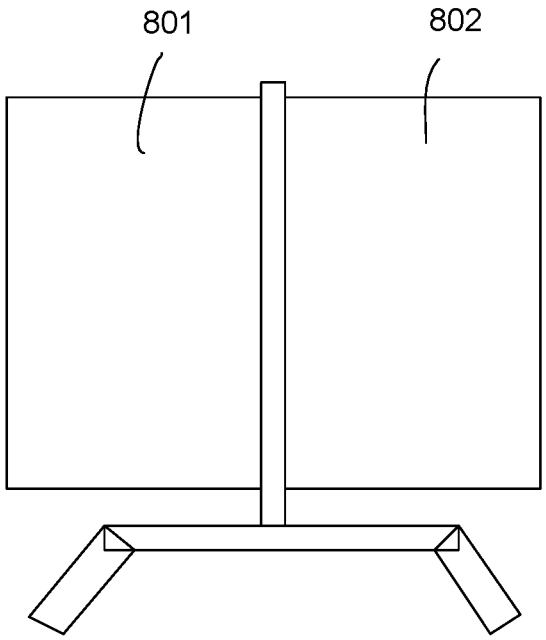
FIG. 8A illustrates another assembly light apparatus embodiment.

FIG. 8A illustrates another assembly light apparatus embodiment. In FIG. 8A, there is a portable light module 801 and a fixed light module 802 arranged in pair, as an alternative variation compared with previous embodiments.

Figure 8B:
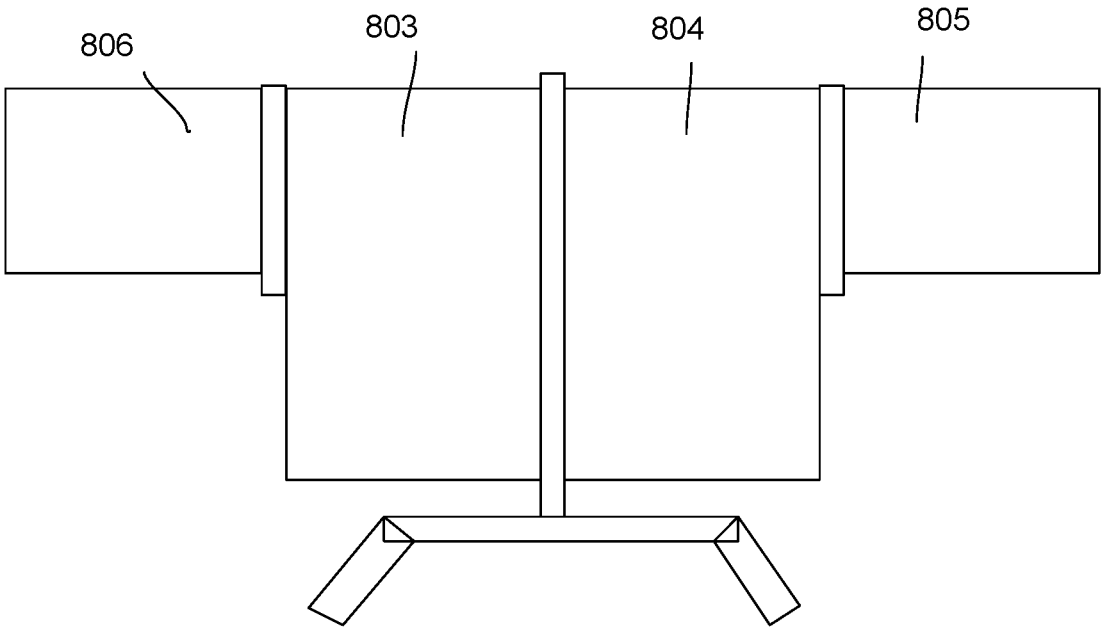
FIG. 8B illustrates another assembly light apparatus embodiment.

FIG. 8B illustrates yet another assembly light apparatus embodiment. In FIG. 8B, there are two portable light modules 803, 804 between two fixed light modules 805, 806. The position of the fixed light modules 805, 806 may also be replaced as portable light modules and vice versa.

In other words, there are various alternative designs within the same inventive scope as explained in this specification.

In addition to the above-described embodiments, various modifications may be made, and as long as it is within the spirit of the same invention, the various designs that can be made by those skilled in the art are belong to the scope of the present invention.

The invention claimed is:

1. An assembly light apparatus, comprising:

a station bracket comprising a fixed holder, a detachable holder and a pose adjuster structure;

a fixed light module fixed on the fixed holder; and a portable light module for being attached on the detachable holder, the pose adjuster structure being operated to rotate to change an angle and a position of the fixed holder and the detachable holder with respect to the station bracket, wherein the portable light module is attached to the detachable holder with a magnetic component.

2. The assembly light apparatus of claim 1, wherein the fixed light module has two fixed units located at two sides of the detachable holder.

3. The assembly light apparatus of claim 2, wherein the two fixed units have a larger half intensity angle than the portable light module.

4. The assembly light apparatus of claim 1, wherein the detachable holder has a position structure to ensure the portable light module to keep at a predetermined position with respect to the detachable holder.

5. The assembly light apparatus of claim 1, wherein the portable light module has a battery to provide electricity of the portable light module to work when the portable light module is detached from the detachable holder.

6. The assembly light apparatus of claim 5, wherein the portable light module has a power electrode connecting to a power receiving electrode of the detachable holder to charge the battery when the portable light module is placed on the detachable holder.

7. The assembly light apparatus of claim 1, wherein the portable light module has a holder bar for user to hold and to escape the portable light module from the detachable holder.

8. The assembly light apparatus of claim 1, wherein the portable light module has a foldable stand, the foldable stand is outreached to keep the portable light module at a desired angle when the portable light module is taken away from the detachable holder, and the foldable stand is retracted for the portable light module to adjoin to the detachable holder when the portable light module is placed on the detachable holder.

9. The assembly light apparatus of claim 1, wherein the station bracket has a station battery with larger capacity than a battery of the portable light module, when the portable light module is placed on the detachable holder, the light module has a different operation mode from when the light module is placed on the detachable holder.

10. The assembly light apparatus of claim 1, wherein the portable light module has more than two directions to be placed on the detachable holder, and when the portable light module is placed with different directions on the detachable holder, the portable light module has different operation modes.

11. The assembly light apparatus of claim 1, wherein the portable light module emits a first light pattern in a first side and emits a second light pattern in a second side, the first side is opposite to the second side, the first light pattern is different from the second light pattern, the portable light module is selectively placed on the detachable holder with the first side or the second side to choose providing the first light pattern or the second light pattern, respectively.

12. The assembly light apparatus of claim 1, wherein the portable light module has a control terminal for receiving a command from the station bracket, users send an operation instruction to the station bracket to operate the fixed light module and the portable light module at the same time.

13. The assembly light apparatus of claim 12, wherein the operation instruction is issued by a remote control to control both the fixed light module and the portable light module when the portable light module is placed on the detachable holder, and the portable light module has a manual switch for controlling the portable light module when the portable light module is detached from the detachable holder.

14. The assembly light apparatus of claim 12, wherein the portable light module is operable independent without the station bracket and has a different operation mode when the portable light module is placed on the detachable holder.

15. The assembly light apparatus of claim 1, wherein the detachable holder is designed to mount another portable device except the portable light module.

16. The assembly light apparatus of claim 1, wherein another portable device is another portable light module having a different light emitting pattern.

17. The assembly light apparatus of claim 1, wherein the station bracket has a bottom base to be placed on a surface, a post adjuster structure having a plurality of joint structures to be rotated to change an angle and a height with respect to the surface.

18. The assembly light apparatus of claim 16, wherein the station bracket has a first bottom joint connected to the bottom base and a second bottom joint connected to the detachable holder to change the height and the angle with respect to the surface.

19. The assembly light apparatus of claim 16, wherein the pose adjuster structure has two top joints for the detachable holder to connect to two fixed units, and the two top joints are used for adjusting respective angles between the two fixed units and the detachable holder.

* * * * *